US009177517B2

(12) United States Patent
Fujioka et al.

(10) Patent No.: US 9,177,517 B2
(45) Date of Patent: Nov. 3, 2015

(54) DISPLAY DEVICE AND DRIVE METHOD THEREFOR

(71) Applicant: Sharp Kabushiki Kaisha, Osaka-shi, Osaka (JP)

(72) Inventors: Akizumi Fujioka, Osaka (JP); Yoshinori Shibata, Osaka (JP); Kazuki Takahashi, Osaka (JP); Toshihiro Yanagi, Osaka (JP); Taketoshi Nakano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/375,161

(22) PCT Filed: Feb. 1, 2013

(86) PCT No.: PCT/JP2013/052351
§ 371 (c)(1),
(2) Date: Jul. 29, 2014

(87) PCT Pub. No.: WO2013/118652
PCT Pub. Date: Aug. 15, 2013

(65) Prior Publication Data

US 2015/0002492 A1 Jan. 1, 2015

(30) Foreign Application Priority Data

Feb. 10, 2012 (JP) ..... 2012-027818

(51) Int. Cl.
*G09G 5/00* (2006.01)
*G09G 3/36* (2006.01)

(52) U.S. Cl.
CPC ..... *G09G 3/3614* (2013.01); *G09G 3/3648* (2013.01); *G09G 3/3674* (2013.01); *G09G 2320/046* (2013.01)

(58) Field of Classification Search
None
See application file for complete search history.

(56) References Cited

U.S. PATENT DOCUMENTS

| | | | | |
|---|---|---|---|---|
| 2002/0093473 | A1 | 7/2002 | Tanaka et al. | |
| 2011/0050553 | A1 | 3/2011 | Takada et al. | |
| 2011/0285759 | A1 | 11/2011 | Sakai | |
| 2013/0222359 | A1 | 8/2013 | Nakata et al. | |
| 2013/0314361 | A1* | 11/2013 | Saitoh et al. | 345/173 |
| 2014/0028646 | A1 | 1/2014 | Saitoh et al. | |
| 2014/0125569 | A1 | 5/2014 | Nakata et al. | |

FOREIGN PATENT DOCUMENTS

| | | | |
|---|---|---|---|
| JP | 2002-278523 | A | 9/2002 |
| JP | 2011-048057 | A | 3/2011 |

(Continued)

OTHER PUBLICATIONS

Official Communication issued in International Patent Application No. PCT/JP2013/052351, mailed on May 7, 2013.

*Primary Examiner* — Adam R Giesy
(74) *Attorney, Agent, or Firm* — Keating & Bennett, LLP

(57) ABSTRACT

A sum of the number of frames constituting a scanning period and the number of frames constituting a pause period is an even number. A polarity of a POL signal in each frame in each of the scanning period and the pause period is reversed every frame. Further, the polarity of the POL signal is reversed at a timing when switching from the scanning period to the pause period is carried out, and is maintained at a timing when switching from the pause period to the scanning period is carried out. Alternatively, the polarity of the POL signal is maintained at a timing when switching from the scanning period to the pause period is carried out, and is reversed at a timing when switching from the pause period to the scanning period is carried out.

17 Claims, 7 Drawing Sheets

| FRAME COUNT | n+1 | n+2 | n+3 | n+4 | n+5 | n+6 | n+7 | n+8 | n+9 | n+10 | n+11 | n+12 | n+13 | n+14 | n+15 | n+16 | n+17 | n+18 |
|---|---|---|---|---|---|---|---|---|---|---|---|---|---|---|---|---|---|---|
| SCANNING PERIOD /PAUSE PERIOD | SCANNING PERIOD | | | | PAUSE PERIOD | | | | SCANNING PERIOD | | | | PAUSE PERIOD | | | | SCANNING PERIOD | |
| POLARITY OF POL SIGNAL | + | − | + | − | − | + | − | + | − | + | − | + | + | − | + | − | + | − |
| POLARITY OF DATA LINE | + | − | + | − | OUTPUT STOPPED | | | | − | + | − | + | OUTPUT STOPPED | | | | + | − |
| POLARITY OF VOLTAGE APPLIED TO LIQUID CRYSTAL | + | − | + | − | − | | | | − | + | − | + | + | | | | + | − |

(56) References Cited

FOREIGN PATENT DOCUMENTS

| | | | | |
|---|---|---|---|---|
| WO | 2010/106713 | A1 | | 9/2010 |
| WO | 2012/057044 | A1 | | 5/2012 |
| WO | 2012/137756 | A1 | | 10/2012 |
| WO | WO 2012137800 | A1 | * | 10/2012 |
| WO | 2013/008668 | A1 | | 1/2013 |

* cited by examiner

FIG. 4

| FRAME COUNT | n+1 | n+2 | n+3 | n+4 | n+5 | n+6 | n+7 | n+8 | n+9 | n+10 | n+11 | n+12 | n+13 | n+14 | n+15 | n+16 | n+17 | n+18 |
|---|---|---|---|---|---|---|---|---|---|---|---|---|---|---|---|---|---|---|
| SCANNING PERIOD /PAUSE PERIOD | SCANNING PERIOD | | | | PAUSE PERIOD | | | | SCANNING PERIOD | | | | PAUSE PERIOD | | | | SCANNING PERIOD | |
| POLARITY OF POL SIGNAL | + | − | + | − | + | − | + | − | − | + | − | + | − | + | − | + | + | − |
| POLARITY OF DATA LINE | + | − | + | − | OUTPUT STOPPED | | | | − | + | − | + | OUTPUT STOPPED | | | | + | − |
| POLARITY OF VOLTAGE APPLIED TO LIQUID CRYSTAL | + | − | + | − | − | | | | − | + | − | + | + | | | | + | − |

DISPLAY DEVICE AND DRIVE METHOD THEREFOR

TECHNICAL FIELD

The present invention relates to a display device which carries out reverse polarity driving, and a method for driving the display device.

BACKGROUND ART

Conventionally, a liquid crystal display device has been mounted in a wide variety of electronic devices. Due to having advantages such as small thickness, light weight, and low power consumption, the liquid crystal display device is expected to be utilized further in the future.

The liquid crystal display device has a problem of having image sticking on a display panel when DC driven. In general, in order to prevent the image sticking, the liquid crystal display device is driven by means of reverse polarity driving. According to the reverse polarity driving, a polarity of image data (data signal) written into each pixel constituting the display panel is reversed every frame. This causes a polarity of a voltage applied to liquid crystal in the each pixel to be reversed every frame as well, so that a polarity of an electric charge in liquid crystal is prevented from being positive more often than negative, and vice versa, while the display device operates. This allows preventing image sticking on the display panel.

On the other hand, in recent years, display devices of various kinds share a common issue of how to reduce power consumption. Pause driving has been proposed as a technique for solving the issue. A display device that carries out the pause driving does not scan a display panel in a certain number of consecutive frames following a frame in which the display device scans the display panel. In this pause period, voltages applied to pixels of the display panel in a frame immediately preceding the pause period are retained, so that what has been displayed is maintained as well. Since display in the pause period is carried out without a process of supplying a signal to the display panel, a reduction in power consumption is achieved.

CITATION LIST

Patent Literature

Patent Literature 1

Japanese Patent Application Publication, Tokukai, No. 2011-48057 A (Publication Date: Mar. 10, 2011)

SUMMARY OF INVENTION

Technical Problem

However, simply applying the pause driving to a liquid crystal display device that carries out the reverse polarity driving may sometimes cause image sticking on the display panel. This problem is discussed below with reference to FIG. 7.

FIG. 7 is a view illustrating a polarity of a voltage applied to liquid crystal in each frame when a conventional liquid crystal display device carries out the pause driving. In an example illustrated in FIG. 7, the number of frames in a scanning signal is four and the number of frames in a pause period is also four. That is, a sum of the number of frames constituting a scanning period and the number of frames constituting a pause period is an even number. A scanning period and a pause period are alternated.

In each scanning period, a polarity of a data signal is reversed every frame. Accordingly, a polarity of a voltage applied to liquid crystal is also reversed every frame. In the case where a sum of the number of frames constituting a scanning period and the number of frames constituting a pause period is an even number, a voltage applied to liquid crystal in the last frame in each scanning period has the same polarity as that of a voltage applied to liquid crystal in the last frame in another scanning period. In the example illustrated in FIG. 7, all of the voltages applied to liquid crystal in the last frames in the respective scanning periods have a positive polarity. In a conventional liquid crystal display device that carries out the pause driving, a voltage applied to liquid crystal in a pixel in the last frame in a scanning period immediately preceding each pause period is retained in the pixel in the each pause period. This is due to an effect of a capacitance component which is present in each pixel. As a result, voltages applied to liquid crystal in any pause periods are identical to each other in the example illustrated in FIG. 7. In the example illustrated in FIG. 7, all of the voltages applied to liquid crystal in the respective pause periods are negative.

Consequently, in a conventional liquid crystal display device that carries out driving as illustrated in FIG. 7, an electric charge in liquid crystal gradually becomes negative more often than positive while the liquid crystal display device operates. This becomes more prominent as a pause period becomes longer. A conventional liquid crystal display device may thus have a case where the liquid crystal display device can carry out the pause driving but cannot avoid having image sticking on a screen of a display panel.

The present invention is accomplished in view of the problem above. According to a display device in accordance with one aspect of the present invention, the pause driving can be carried out without causing image sticking on a display panel.

Solution to Problem

In order to achieve the object, a display device in accordance with one aspect of the present invention is a display device which includes: a display panel including a plurality of scanning lines, a plurality of data lines intersecting with the plurality of scanning lines, and a plurality of pixels provided separately near at respective intersections of the plurality of scanning lines and the plurality of data lines; a control signal output section outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period is an even number; a polarity designation signal output section outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frame(s) within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and a drive circuit supplying the data signal to the each of the plurality of data lines in the each of the frames in the scanning period, the data signal having a polarity based on the polarity of the polarity designation signal supplied to the drive circuit in the each of the frames.

In order to achieve the object, a method in accordance with one aspect of the present invention for driving a display device is a method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method including the steps of: (a) outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period is an even number; (b) outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frame(s) of a polarity inversion cycle, which is at least one (1), within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and (c) supplying the data signal to the each of the plurality of data lines in the each of the frames in the scanning period, the data signal having a polarity based on the polarity of the polarity designation signal supplied in the each of the frames.

In order to achieve the object, a display device in accordance with one aspect of the present invention is a display device which includes: a display panel including a plurality of scanning lines, a plurality of data lines intersecting with the plurality of scanning lines, and a plurality of pixels provided separately near at respective intersections of the plurality of scanning lines and the plurality of data lines; a control signal output section outputting a control signal which alternately designates a scanning period in which a whole region of a screen of the display panel is scanned and a pause period in which an at least partial region of the screen is not scanned, wherein a value obtained by dividing a sum of the number of frames constituting the scanning period and the number of frames constituting the pause period by a polarity inversion cycle that is two or more, is an even number; a polarity designation signal output section outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frames of the polarity inversion cycle within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and a drive circuit supplying the data signal to the each of the plurality of data lines and in the each of the frames in the scanning period, the data signal having a polarity based on the polarity of the polarity designation signal supplied to the drive circuit in the each of the frames.

In order to achieve the object, a method in accordance with one aspect of the present invention for driving a display device is a method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method comprising the steps of: (a) outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period by a polarity inversion cycle that is two or more, is an even number; (b) outputting a polarity designation signal, which designates a polarity of a data signal supplied to each of the plurality of data lines, the polarity designation signal being outputted in each of the frames in the scanning period and in each of the frames in the pause period while a polarity of the polarity designation signal is reversed every certain number of frames of the polarity inversion cycle within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and (c) supplying the data signal to the each of the plurality of data lines in the each of the frames in the scanning period, the data signal having a polarity based on the polarity of the polarity designation signal supplied in the each of the frames.

Advantageous Effects of Invention

A display device in accordance with one aspect of the present invention has an advantageous effect that the display device is capable of carrying out pause driving and does not have image sticking on a display panel.

BRIEF DESCRIPTION OF DRAWINGS

FIG. 4 is a view illustrating an example of a polarity of a voltage applied to liquid crystal in each frame when a display device in accordance with an embodiment of the present invention carries out pause driving.

DESCRIPTION OF EMBODIMENTS

The following description will discuss in detail an embodiment of the present invention with reference to drawings. In the description below, the same reference sign will be given to members having the same function and effect, and description on such members will not be repeated.

[First Embodiment]

(Arrangement of Display System 1)

Figure 1:
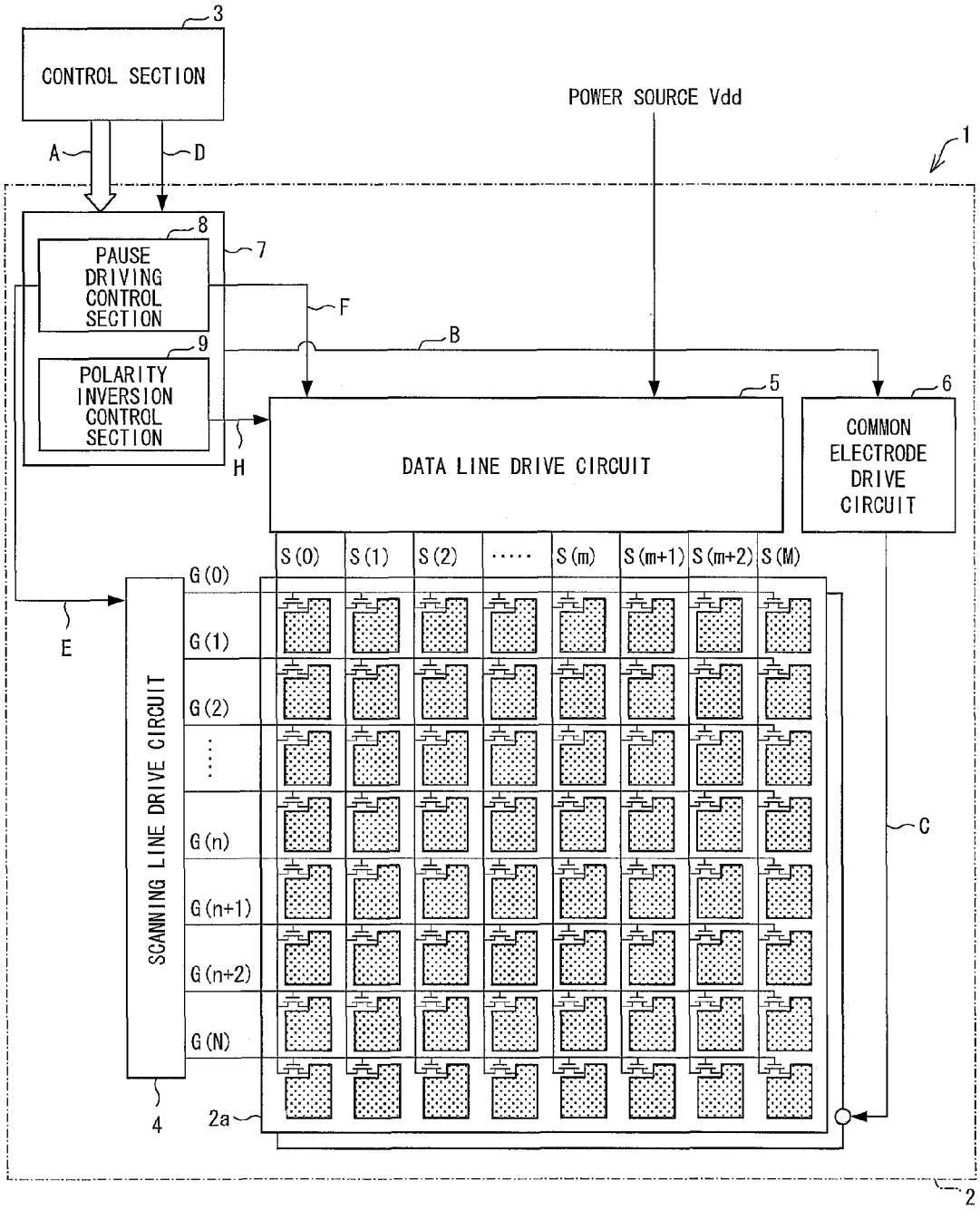
FIG. 1 is a block diagram illustrating a substantial arrangement of a display system in accordance with an embodiment of the present invention.

The following description will discuss, with reference to FIG. 1, an arrangement of a display system 1 in accordance with the present embodiment. FIG. 1 is a block diagram illustrating details of an arrangement of the display system 1 in accordance with the present embodiment. As illustrated in FIG. 1, the display system 1 includes a display device 2 and a control section 3. In the display system 1 of the present embodiment, the control section 3 outputs video via the display device 2 so that the video is displayed. Apart from video, the control section 3 is also capable of outputting, to the display device 2, given information such as a static image or a sign.

The display device 2 includes a display panel 2*a*, a scanning line drive circuit 4, a data line drive circuit 5 (a drive circuit), a common electrode drive circuit 6, and a timing control section 7 (a video signal reception section). The timing control section 7 includes a pause driving control section 8 (a control signal output section, a designation signal reception section, a video signal reception section, a frame count calculation section, and a determination value calculation section) and a polarity inversion control section 9 (a polarity designation signal output section).

The display panel 2*a* includes a screen which includes a plurality of pixels arranged in matrix. The display panel 2*a* also includes N (N is a given integer) scanning lines G (gate lines) for scanning the screen sequentially on a line by line basis. The display panel 2*a* further includes M (M is a given integer) data lines S (source lines) for supplying data signals to pixels equivalent to one (1) row and included in a selected line. The scanning lines G and the data lines S intersect with each other. The plurality of pixels are provided separately near at respective intersections between the plurality of scanning lines G and the plurality of data lines S.

The display panel 2*a* further includes a liquid crystal layer (not shown). That is, the display device 2 is what is called a liquid crystal display device.

Figure 2:
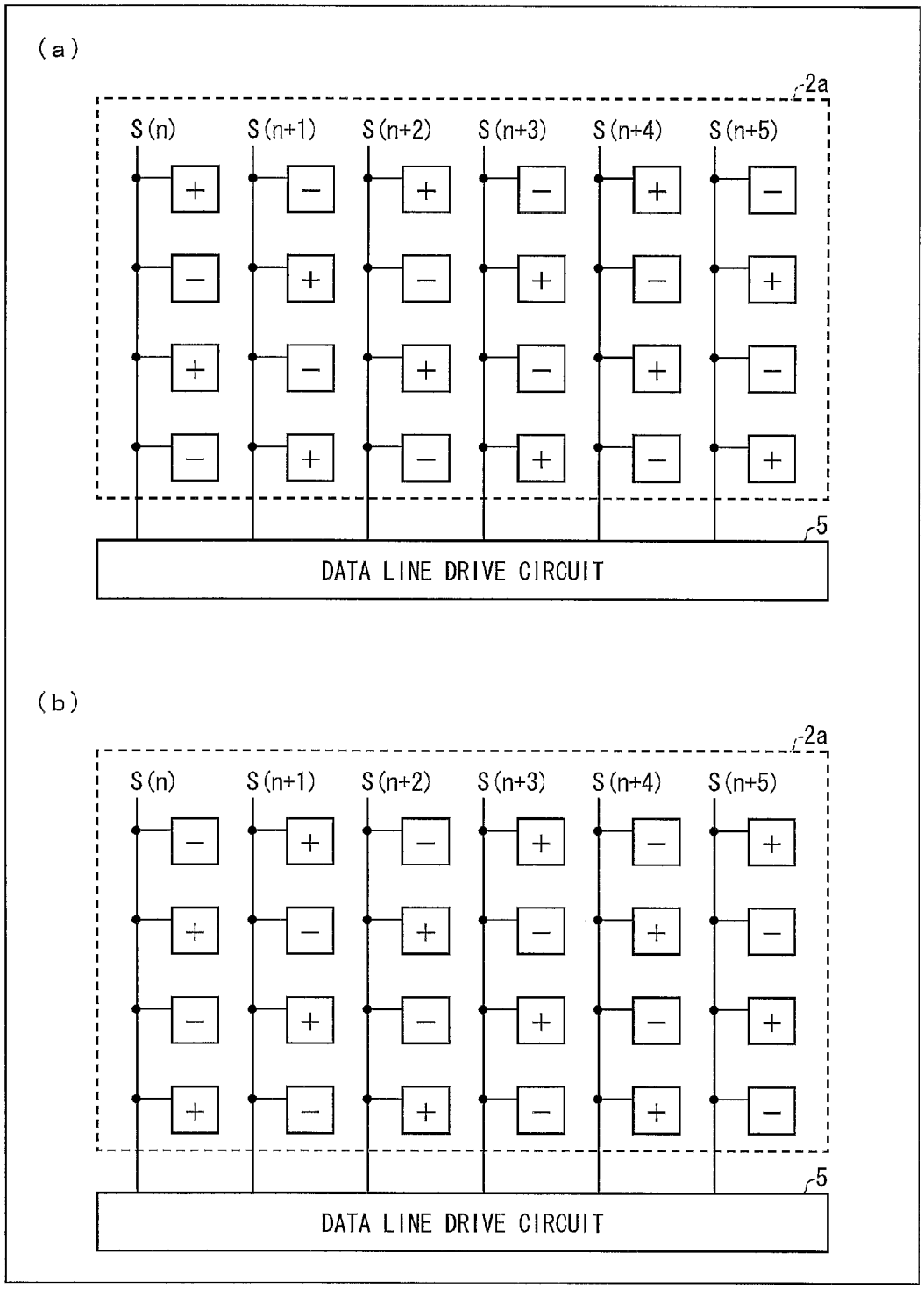
FIG. 2 is a view illustrating a display panel in a state where data signals are written by a 'dot inversion' polarity inversion method.

In FIG. 2, G(n) represents an n-th (n is an integer not smaller than one but not greater than N) scanning line G. For example, G(1), G(2), and G(3) represent first, second, and third scanning lines G, respectively. S(m) represents an m-th (m is an integer not smaller than one but not greater than M) data line S. For example, S(1), S(2), and S(3) represent first, second, and third data lines S, respectively.

The scanning line drive circuit 4, for example, scans the plurality of scanning lines G sequentially from top to bottom of the screen. At this time, the scanning line drive circuit 4 supplies, to each of the plurality of scanning lines G, a rectangular wave for bringing a switching element (pixel thin-film transistor (TFT)), which is provided in a pixel and connected to a pixel electrode, to an ON state. In this way, the scanning line drive circuit 4 causes pixels equivalent to one (1) row in the screen to be selected.

The data line drive circuit 5 calculates, on the basis of a video signal (arrow A) supplied from the control section 3, a value of a voltage to be supplied to each of the selected pixels equivalent to one (1) row, and supplies, to corresponding one of the plurality of data lines S, a voltage (data signal) having the calculated value. In this manner, the data line drive circuit 5 supplies image data to the pixels (pixel electrodes) provided on the selected one of the plurality of scanning line G.

The display device 2 includes a common electrode (not shown) provided for the plurality of pixels in the screen. The common electrode drive circuit 6 supplies the common electrode with a predetermined common voltage for driving the common electrode (arrow C), on the basis of a signal (arrow B) supplied from the timing control section 7.

The timing control section 7 supplies each of the circuits with a signal which serves as a reference for the circuits to operate in synchronization with each other, on the basis of the clock signal, the horizontal sync signal, and the vertical sync signal which are supplied from the control section 3. Specifically, the timing control section 7 supplies a gate start pulse signal GSP, a gate clock signal GCK, and a gate output enable signal GOE to the scanning line drive circuit 4 on the basis of the clock signal, the horizontal sync signal, and the vertical sync signal. The timing control section 7 supplies a source start pulse signal SSP, a source latch strobe signal SLS, and a source clock signal SCK to the data line drive circuit 5 on the basis of the clock signal, the horizontal sync signal, and the vertical sync signal.

The scanning line drive circuit 4 starts scanning the display panel 2*a* in response to the gate start pulse signal GSP received from the timing control section 7, and applies a selection voltage to the plurality of scanning lines G sequentially in accordance with the gate clock signal GCK, which is a signal that causes selection of a scanning line G to be shifted sequentially among the plurality of scanning lines G. The data line drive circuit 5 stores, in response to the source start pulse signal SSP received from the timing control section 7, supplied image data of each pixel in a register in accordance with the source clock signal SCK. After storing the image data, the data line drive circuit 5 writes the image data into a corresponding pixel electrode via a corresponding data line S of the display panel 2*a* in accordance with the next source latch strobe signal SLS. The image data is written into the pixel electrode by means of, for example, an analog amplifier included in the data line drive circuit 5.

Note that a voltage necessary for each circuit in the display system 1 to operate is supplied, for example, from a power supply circuit (not shown), which may be included in the control section 3. An example of the voltage necessary for each circuit in the display system 1 to operate is a power supply voltage Vdd which is supplied to the data line drive circuit 5.

(Pause Driving)

The display device 2 carries out what is called pause driving in order to reduce power consumption while the display device 2 operates. The following description will discuss the pause driving carried out by the display device 2.

In the display system 1, the control section 3 instructs the display device 2 to carry out the pause driving. At this time, the control section 3 supplies a control signal (designation signal) indicated by an arrow D to the timing control section 7. The control signal thus supplied from the outside of the display device 2 is received by the pause driving control section 8 in the timing control section 7. The control signal includes information indicative of the number of frames constituting a scanning period in which a whole region of the screen of the display panel 2*a* is scanned and information indicative of the number of frames constituting a pause period in which an at least partial region of the screen is not scanned. The at least partial region is hereinafter referred to as a pause region.

The pause driving control section 8 calculates, on the basis of the control signal received, the number of frames constituting a scanning period and the number of frames constituting a pause period. In this case, since the control signal includes said pieces of information respectively indicative of the number of frames constituting a scanning period and the number of frames constituting a pause period, the pause driving control section 8 calculates the number of frames constituting a scanning period and the number of frames constituting a pause period by simply employing, as the calculated numbers of the frames, the respective numbers indicated by the pieces of information.

The pause driving control section 8 generates a control signal that alternately designates a scanning period constituted by the calculated number of frames and a pause period constituted by the calculated number of frames, and supplies the control signal to the scanning line drive circuit 4 and the data line drive circuit 5 (arrows E and F). At this time, for example, the pause driving control section 8 supplies a control signal that has an H value in each frame in a scanning period and an L value in each frame in a pause period. The pause driving of the display device 2 can thus be controlled from the outside of the display system 1.

The scanning line drive circuit 4 and the data line drive circuit 5 specify a scanning period and a pause period on the basis of the control signal received. In each frame in the scanning period, the scanning line drive circuit 4 supplies a scanning signal to each of the plurality of scanning lines G in the entire screen of the display panel 2*a*, and the data line drive circuit 5 supplies a data signal to each of the plurality of data lines S in the entire screen of the display panel 2*a*. On the other hand, in each frame in the pause period, the scanning line drive circuit 4 supplies no scanning signal to each scanning line G in the pause region. Note that the data line drive circuit 5 does not have to supply any data signal to each data line S in the pause region.

The processes described above allow reducing at least power consumption required for supplying a scanning signal to the pause region in a pause period. This yields a significant reduction in power consumption of the display device 2 in a pause period as compared with a drive period. This allows the display device in accordance with one aspect of the present invention to operate with electric power lower than that required in a display device that does not carry out pause driving. Further, it is preferable that no data signal be supplied to each data line S in the pause region in a pause period. This allows power consumption required for supplying a data signal to the pause region in a pause period to be reduced as well. Consequently, the power consumption in the display device 2 is further reduced. Note that a data signal for black display may be supplied to each data line S in the pause region.

In each pause period, a TFT in a pixel is turned off, so that a voltage applied to liquid crystal of the pixel in a frame immediately preceding the pause period is maintained as it is. Accordingly, an image which has been displayed is also maintained into each pause period. That is, the pause driving is suitable for a case of displaying a video including a region in which displayed content does not change over a certain number of frames.

(Calculation of Frame Count Based on Video Signal)

The pause driving control section 8 is capable of calculating, on the basis of the video signal indicated by the arrow A, the number of frames constituting a scanning period and the number of frames constituting a pause period. In this case, the control signal indicated by the arrow D is not supplied from the control section 3 to the timing control section 7. The pause driving control section 8 analyzes content of the received video signal to thereby calculate the number of frames constituting a scanning period and the number of frames constituting a pause period, in accordance with the video represented by the video signal. As such, in a case where the content of the video represented by the video signal changes, the number of frames calculated also changes. In this way, the pause driving control section 8 generates a control signal that designates a scanning period constituted by an optimum number of frames according to the video signal and a pause period constituted by an optimum number of frames according to the video signal. This allows the display device 2 to carry out optimum pause driving according to the video signal.

(Calculation of Frame Count According to Information in Memory)

The pause driving control section 8 is capable of calculating, on the basis of information stored in a memory (a storage section) (not shown), the number of frames constituting a scanning period and the number of frames constituting a pause period. In this case, the control signal indicated by the arrow D is not supplied from the control section 3 to the timing control section 7. In addition, the pause driving control section 8 does not have to analyze the video signal.

In the memory, information indicative of the number of frames constituting a scanning period and information indicative of the number of frames constituting a pause period are stored in advance. The pause driving control section 8 reads out these pieces of information from the memory, and calculates the number of frames constituting a scanning period and the number of frames constituting a pause period by simply employing, as the calculated numbers of the frames, the respective numbers indicted by the pieces of information.

(Reverse Polarity Driving)

The display device 2 carries out what is called reverse polarity driving in order to prevent occurrence of flicker and image sticking on the screen while the display device 2 operates. The following description will discuss the reverse polarity driving.

In the display device 2, the pause driving control section 8 in the timing control section 7 supplies the data line drive circuit 5 with a polarity designation signal (hereinafter referred to as a POL signal) which designates a polarity of a data signal supplied to each of the plurality of data lines (arrow H). In the present embodiment, the polarity inversion control section 9 outputs the POL signal while reversing a polarity of the POL signal every frame.

In each frame in a scanning period, the data line drive circuit 5 supplies, to each of the plurality of data lines S, a data signal having a polarity that is based on the polarity of the POL signal supplied to the data line drive circuit 5 in the each frame. For example, in a case where the POL signal has a positive (+) polarity, the data line drive circuit 5 supplies each of the plurality of data lines S with a data signal that also has a positive (+) polarity. On the other hand, in a case where the POL signal has a negative (−) polarity, the data line drive circuit 5 supplies each of the plurality of data lines S with a data signal that also has a negative (−) polarity.

Since the polarity of the POL signal is reversed every frame, the polarity of the data signal outputted from the data line drive circuit 5 is also reversed every frame. Accordingly, in the display device 2, the polarity of the voltage applied to liquid crystal in each frame in a scanning period is also reversed every frame.

Note that the polarity of the POL signal and the polarity of the data signal supplied to each of the plurality of data lines S are not necessarily identical to each other. For example, in a case where the reverse polarity driving is carried out in accordance with 'dot inversion method' or 'source inversion method' (each described later), the polarity of the data signal is reversed every data line S in a frame. As such, the display device 2 is also capable of carrying out a process in which, in a case where the POL signal has a positive polarity in a frame, a data line supplied to a data line S(0) in the frame has a positive polarity whereas a data signal supplied to a data signal S(1) in the frame has a negative polarity. In the display device 2, to 'supply each of the plurality of data lines S with a data signal having a polarity based on the polarity of the POL signal' fundamentally means to 'cause the polarity of the data signal supplied to the each of the plurality of data lines S to be reversed every time the polarity of the POL signal is reversed'.

(Concrete Examples of Polarity Inversion Method)

Figure 3:
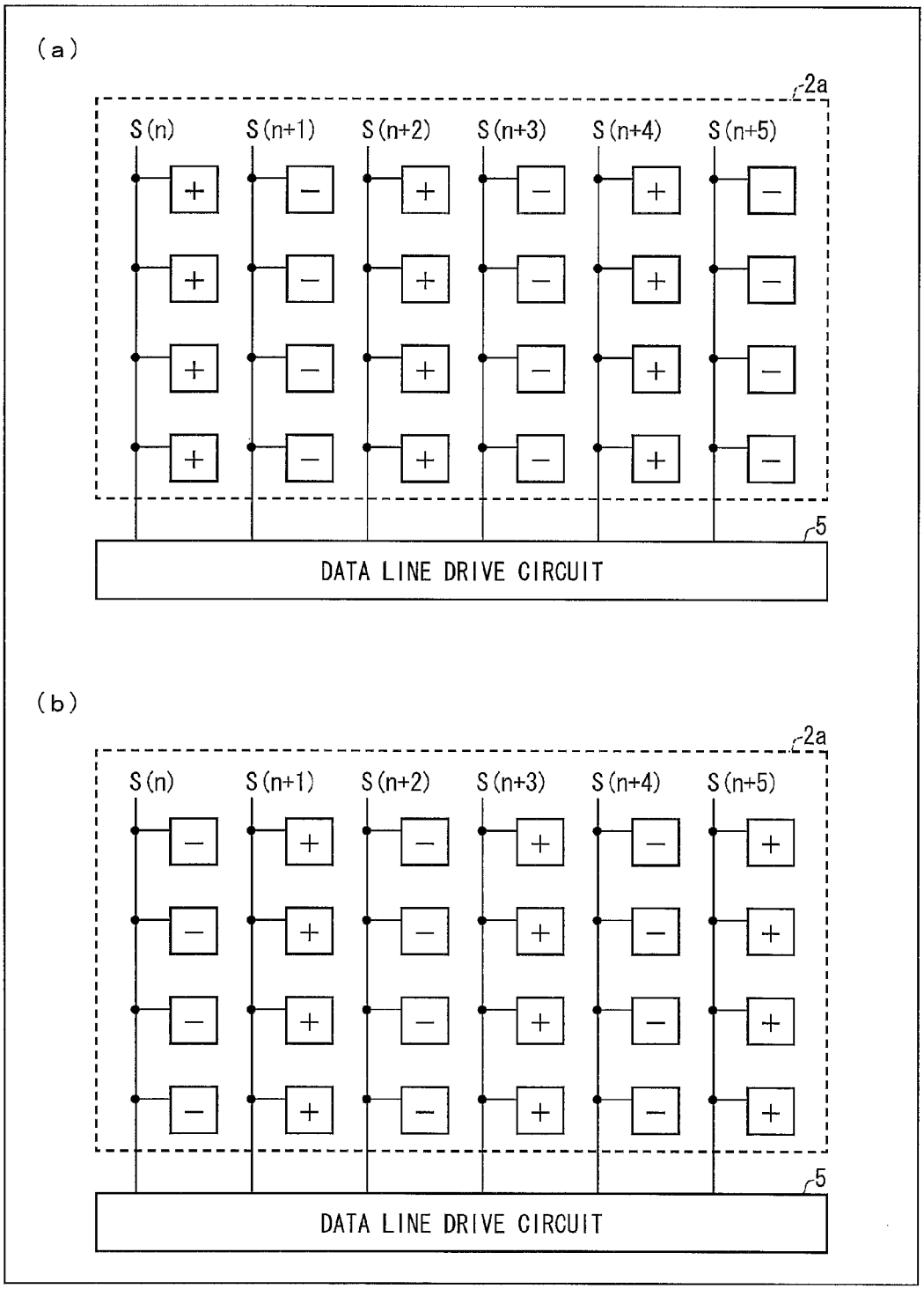
FIG. 3 is a view illustrating a display panel in a state where data signals are written by a 'source inversion' polarity inversion method.

The following description will concretely discuss a polarity inversion method with reference to FIGS. 2 and 3. In the following description, each of a 'dot inversion' polarity inversion method and a 'source inversion' polarity inversion method will be described by using pixels arranged in six pixel rows×four pixel columns among the plurality of pixels provided in the display panel 2*a*.

FIG. 2 is a view illustrating the display panel 2*a* in a state where source signals are written by the 'dot inversion' polarity inversion method. FIG. 3 is a view illustrating the display panel 2*a* in a state where source signals are written by the 'source inversion' polarity inversion method.

In each of FIGS. 2 and 3, a pixel indicated with '+' represents a state in which positive polarity data is written into the pixel, and a pixel indicated with '−' represents a state in which negative polarity data is written into the pixel.

In each of FIGS. 2 and 3, polarities of source signals for the respective pixels are reversed between (a) and (b).

(Spatial Cycle of Polarity Inversion)

As illustrated in FIG. 2, according to the 'dot inversion' polarity inversion method, pixels in each pixel row are arranged so that polarities of source signals for the respective pixels in the each pixel row are reversed every pixel along spatial directions (a pixel row direction and a pixel column direction) of the display panel, specifically, '+, −, +, −' or '−, +, −, +'.

As illustrated in FIG. 3, according to the 'source inversion' polarity inversion method, pixels in each pixel row are arranged so that source signals for the respective pixels in the each pixel row have an identical polarity, specifically, '+, +, +, +' or '−, −, −, −', and pixels in each pixel column are arranged so that polarities of source signals for the respective pixels in the each pixel column are reversed every pixel, specifically, '+, −, +, −' or '−, +, −, +'.

(Temporal Cycle of Polarity Inversion)

As illustrated in FIG. 2, in a case where 'dot inversion' is employed as a spatial cycle of the polarity inversion, employment of 'one-frame inversion' as a temporal cycle of the polarity inversion causes the polarity of each pixel in the display panel 2*a* to be reversed every frame so that, for example, the display panel 2*a* sequentially undergoes the states of '(a) of FIG. 2, (b) of FIG. 2, (a) of FIG. 2, (b) of FIG. 2, . . . '. In the case where 'dot inversion' is employed, employment of 'two-frame inversion' as a temporal cycle of the polarity inversion causes the polarity of each pixel in the display panel 2*a* to be reversed every two frames so that, for example, the display panel 2*a* sequentially undergoes the states of '(a) of FIG. 2, (a) of FIG. 2, (b) of FIG. 2, (b) of FIG. 2, . . . '.

Similarly, as illustrated in FIG. 3, in a case where 'source inversion' is employed as a spatial cycle of the polarity inversion, employment of 'one-frame inversion' as a temporal cycle of the polarity inversion causes the polarity of each pixel in the display panel 2*a* to be reversed every frame so that, for example, the display panel 2*a* sequentially undergoes the states of '(a) of FIG. 3, (b) of FIG. 3, (a) of FIG. 3, (b) of FIG. 3, . . . '. In the case where 'source inversion' is employed, employment of 'two-frame inversion' as a temporal cycle of the polarity inversion causes the polarity of each pixel in the display panel 2*a* to be reversed every two frames so that, for example, the display panel 2*a* sequentially undergoes the states of '(a) of FIG. 3, (a) of FIG. 3, (b) of FIG. 3, (b) of FIG. 3, . . . '.

(Combination of Pause Driving and Reverse Polarity Driving)

The display device 2 of the present embodiment carries out the pause driving and the reverse polarity driving simultaneously. This point will be discussed in detail below with reference to FIG. 4.

FIG. 4 is a view illustrating a polarity of a voltage applied to liquid crystal in each frame when the display device 2 of the present embodiment carries out the pause driving. In an example illustrated in FIG. 4, the number of frames constituting a scanning signal is four, and the number of frames constituting a pause period is four. That is, a sum of the number of frames constituting a scanning period and the number of frames constituting a pause period is an even number.

In the display device 2 of the present embodiment, the polarity of the POL signal is reversed every frame in each scanning period and in each pause period. In the example illustrated in FIG. 4, the POL signal has a positive polarity in an (n+1)-th frame (n is a natural number) in a scanning period, a negative polarity in a subsequent (n+2)-th frame, a positive polarity in a further subsequent (n+3)-th frame, and a negative polarity in a still further subsequent (n+4)-th frame.

As described above, in the display device 2, a data signal having a polarity based on the polarity of the POL signal is supplied to each of the plurality of data lines S in each frame in each scanning signal. In the example illustrated in FIG. 4, when the POL signal has a positive polarity, a data signal that also has a positive polarity is supplied to each of the plurality of data lines S. On the other hand, when the POL signal has a negative polarity, a data signal that also has a negative polarity is supplied to each of the plurality of data lines S. Accordingly, in each frame, the polarity of the POL signal and the polarity of each of the plurality of data lines S are identical to each other.

In the present embodiment, the polarity of the POL signal is reversed at a timing when switching from a scanning period to a pause period is carried out. Accordingly, in the example illustrated in FIG. 4, the POL signal has a positive polarity in an (n+5)-th frame in a pause period. Further, as described above, the polarity of the POL signal is reversed every frame in a pause period. Accordingly, the POL signal has a negative polarity in an (n+6)-th frame which is subsequent to the (n+5)-th frame, a positive polarity in a further subsequent (n+7)-th frame, and a negative polarity in a still further subsequent (n+8)-th frame.

In the present embodiment, the polarity of the POL signal is maintained without being reversed at a timing when switching from a pause period to a scanning period is carried out. Accordingly, in the example illustrated in FIG. 4, the POL signal has a negative polarity in an (n+9)-th frame in a scanning period, a positive polarity in an (n+10)-th frame subsequent to the (n+9)-th frame, a negative polarity in a further subsequent (n+11)-th frame, and a positive polarity in a still further subsequent (n+12)-th frame.

As described above, in the present embodiment, the polarity of each of the plurality of data lines S in the first frame in each scanning period is reversed every scanning period. For example, each of the plurality of data lines S has a positive polarity in the (n+1)-th frame which is the first frame in the first scanning period in FIG. 4, a negative polarity in the (n+9)-th frame which is the first frame in the subsequent scanning period, and a positive polarity in an (n+17)-th frame which is the first frame in the further subsequent scanning period.

As a result, the polarity of each of the plurality of data lines S in the last frame in each scanning period is also reversed every scanning period. For example, each of the plurality of data lines S has a negative polarity in the (n+4)-th frame which is the last frame in the first scanning period in FIG. 4, a positive polarity in the (n+12)-th frame which is the last frame in the subsequent scanning period, and a positive polarity in an (n+20)-th frame which is the last frame in the further subsequent scanning period.

In the display device 2, a voltage applied to liquid crystal is maintained in each pixel in each pause period which voltage has a polarity identical to that of each of the plurality of data lines S in the last frame in a scanning period immediately preceding the each pause period. This is due to an effect of a capacitance component which is present in each pixel. Accordingly, in the display device 2 of the present embodiment, the polarity of the voltage applied to liquid crystal and retained in each pixel in each pause period is reversed every pause period. For example, all of the voltages applied to liquid crystal in the respective frames in the first pause period shown in FIG. 4 are positive, all of the voltages applied to liquid crystal in the respective frames in the subsequent pause period are negative, and all of the voltages applied to liquid crystal in the respective frames in the further subsequent pause period are positive.

As described above, in the display device 2 of the present embodiment, the polarity of the voltage applied to liquid crystal is reversed every frame in each scanning period, as shown in FIG. 4. Further, the polarity of the voltage applied to liquid crystal is also reversed every pause period. Accordingly, even when the display device 2 continues operating, the polarity of the voltage applied to liquid crystal in each pixel is well balanced, without being positive more often than negative, and vice versa. This prevents imbalance in electric charge in liquid crystal and, accordingly, prevents occurrence of image sticking on the display panel.

MODIFIED EXAMPLE

Figure 5:
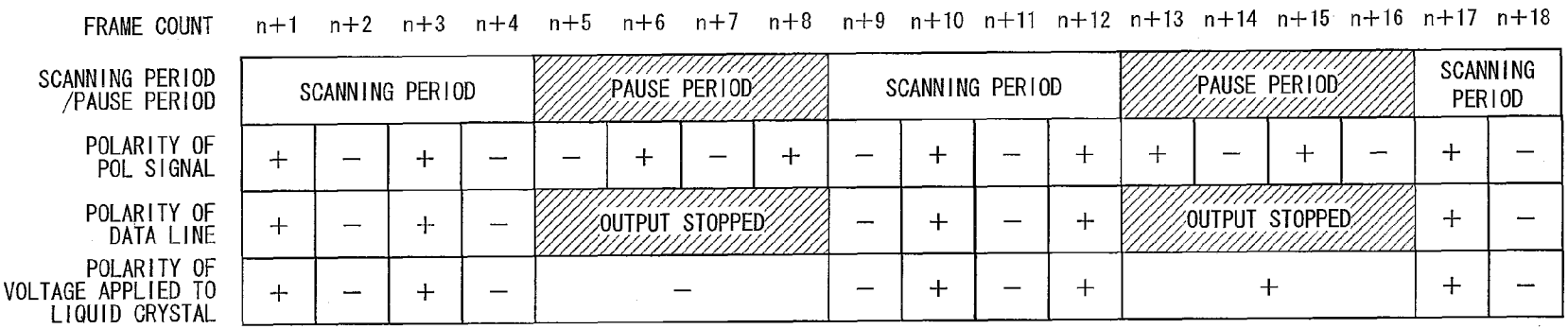
FIG. 5 is a view illustrating another example of a polarity of a voltage applied to liquid crystal in each frame when a display device in accordance with an embodiment of the present invention carries out pause driving.

FIG. 5 is a view illustrating a polarity of a voltage applied to liquid crystal in each frame when the display device 2 of the present embodiment carries out the pause driving. In the modified example, the number of frames constituting a scanning signal is four, and the number of frames constituting a pause period is four. That is, a sum of the number of frames constituting a scanning period and the number of frames constituting a pause period is an even number.

In the display device 2 of the modified example, the polarity of the POL signal is reversed every frame in each scanning period and in each pause period. In the example illustrated in FIG. 5, the POL signal has a positive polarity in an (n+1)-th frame (n is a natural number) in a scanning period, a negative polarity in a subsequent (n+2)-th frame, a positive polarity in a further subsequent (n+3)-th frame, and a negative polarity in a still further subsequent (n+4)-th frame.

In the modified example, the polarity of the POL signal is maintained without being reversed at a timing when switching from a scanning period to a pause period is carried out. Accordingly, in the example illustrated in FIG. 5, the POL signal has a negative polarity in an (n+5)-th frame in a pause period. Further, as described above, the polarity of the POL signal is reversed every frame in a pause period. Accordingly, the POL signal has a positive polarity in an (n+6)-th frame which is subsequent to the (n+5)-th frame, a negative polarity in a further subsequent (n+7)-th frame, and a positive polarity in a still further subsequent (n+8)-th frame.

In the modified example, the polarity of the POL signal is reversed at a timing when switching from a pause period to a scanning period is carried out. Accordingly, in the example illustrated in FIG. 5, the POL signal has a negative polarity in an (n+9)-th frame in a scanning period, a positive polarity in an (n+10)-th frame subsequent to the (n+9)-th frame, a negative polarity in a further subsequent (n+11)-th frame, and a positive polarity in a still further subsequent (n+12)-th frame.

As described above, in the modified example, the polarity of each of the plurality of data lines S in the first frame in each scanning period is reversed every scanning period. For example, each of the data lines S has a positive polarity in the (n+1)-th frame which is the first frame in the first scanning period in FIG. 5, a negative polarity in the (n+9)-th frame which is the first frame in the subsequent scanning period, and a positive polarity in an (n+17)-th frame which is the first frame in the further subsequent scanning period.

As a result, the polarity of each of the plurality of data lines S in the last frame in each scanning period is also reversed every scanning period. For example, each of the plurality of data lines S has a negative polarity in the (n+4)-th frame which is the last frame in the first scanning period in FIG. 5, a positive polarity in the (n+12)-th frame which is the last frame in the subsequent scanning period, and a positive polarity in an (n+20)-th frame which is the last frame in the further subsequent scanning period.

Consequently, in the display device 2 of the modified example, the polarity of the voltage applied to liquid crystal and retained in each pixel in each pause period is reversed every pause period. For example, all of the voltages applied to liquid crystal in the respective frames in the first pause period shown in FIG. 5 are positive, all of the voltages applied to liquid crystal in the respective frames in the subsequent pause period are negative, and all of the voltages applied to liquid crystal in the respective frames in the further subsequent pause period are positive.

As described above, in the display device 2 of the modified example, the polarity of the voltage applied to liquid crystal is reversed every frame in each scanning period, as shown in FIG. 5. Further, the polarity of the voltage applied to liquid crystal is also reversed every pause period. Accordingly, even when the display device 2 continues operating, the polarity of the voltage applied to liquid crystal in each pixel is well balanced, without being positive more often than negative, and vice versa. This prevents imbalance in electric charge in liquid crystal and, accordingly, prevents occurrence of image sticking on the display panel.

(Sum of Frame Counts is Fixed to Even Number)

In the display system 1, when the control section 3 instructs the display device 2 to carry out the pause driving, the control section 3 can also supply the timing control section 7 with such a control signal that a sum of the number of frames constituting a scanning period and the number of frames constituting a pause period is an odd number. When the pause driving control section 8 calculates, on the basis of the control signal, the number of frames constituting a scanning period and the number of frames constituting a pause period, a sum of these numbers of the frames is an odd number. As such, in a case where the pause driving control section 8 generates, simply based on the calculation result, a control signal (arrows E and F) for designating a scanning period and a pause period, the polarity of the POL signal is fixed to positive or negative in the last frame of each scanning period. This causes image sticking on the display panel 2*a*, similarly as in the conventional technique.

However, in the display device 2 in accordance with the present embodiment, in a case where the sum of the calculated numbers of the frames is an odd number, the pause driving control section 8 recalculates each of the number of frames constituting a scanning period and the number of frames constituting a pause period until the sum becomes an even number. For example, in a case where the pause driving control section 8 has calculated the number of frames constituting a scanning period as three and the number of frames constituting a pause period as four, the pause driving control section 8 immediately recalculates the former as four and the latter as four. In other words, whatever control signal the pause driving control section 8 receives, the pause driving control section 8 keeps the sum of the number of frames constituting a scanning period and the number of frames constituting a pause period an even number. That is, the pause driving control section 8 ignores an instruction to make the sum of the number of frames constituting a scanning period and the number of frames constituting a pause period an odd number.

In this way, in the display device 2 in accordance with the present embodiment, the sum of the number of frames constituting a scanning period and the number of frames constituting a pause period is always fixed to an even number and never changes to an odd number. This makes it possible to maintain always a state in which the polarity of the voltage applied to liquid crystal in each pixel is prevented from being positive more often than negative, and vice versa. Accordingly, a state in which the display panel does not have image sticking is always maintained as well.

As described above, the display device 2 in accordance with the present embodiment has an advantage that the display device 2 is capable of carrying out the pause driving and does not have image sticking on the display panel.

(Pixels of Display Panel 2*a*)

Next, the following description will discuss pixels included in the display panel 2*a* of the display device 2 in accordance with the present embodiment.

The display device 2 of the present embodiment employs, as the TFT of each of the plurality of pixels included in the display panel 2*a*, a TFT in which a semiconductor layer is constituted by what is called an oxide semiconductor. Specifically, the display device 2 of the present embodiment employs a TFT in which a semiconductor layer is constituted by, as the oxide semiconductor, what is called IGZO ($InGaZnO_x$) which is an oxide constituted by indium (In), gallium (Ga), and zinc (Zn). Advantages of a TFT in which an oxide semiconductor is used will be described below.

(TFT Characteristic)

Figure 6:
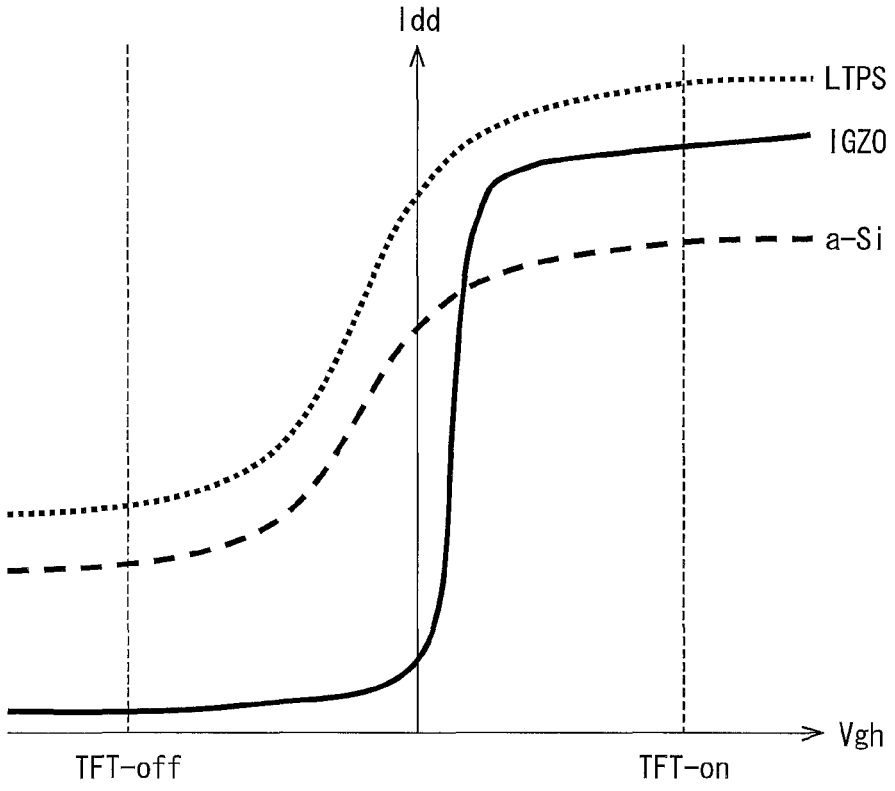
FIG. 6 is a view showing characteristics of various TFTs including a TFT in which an oxide semiconductor is used.
Figure 7:
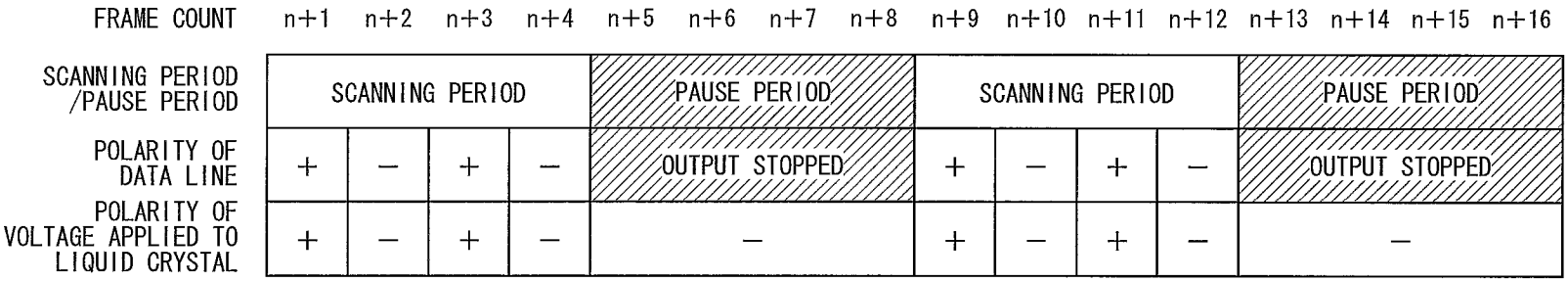
FIG. 7 is a view illustrating a polarity of a voltage applied to liquid crystal in each frame when a conventional liquid crystal display device carries out pause driving.

FIG. 6 is a view showing characteristics of various TFTs including a TFT in which an oxide semiconductor is used. FIG. 6 shows a characteristic of the TFT in which the oxide semiconductor is used, a characteristic of a TFT in which a-Si (amorphous silicon) is used, and a characteristic of a TFT in which LTPS (Low Temperature Poly Silicon) is used.

In FIG. 6, a horizontal axis (Vgh) indicates a value of an ON voltage supplied to a gate of each of the TFTs, and a vertical axis (Id) indicates an amount of an electric current between a source and a drain of each of the TFTs.

Specifically, a period indicated as 'TFT-on' in FIG. 6 represents a period in which each of the TFTs is in an ON state in accordance with the value of the ON voltage, and a period indicated as 'TFT-off' in FIG. 6 represents a period in which each of the TFTs is in an OFF state in accordance with the value of the ON voltage.

As shown in FIG. 6, the TFT in which the oxide semiconductor is used has a higher electron mobility when the TFT is in the ON state, as compared with the TFT in which a-Si is used.

Though not shown, specifically, the TFT in which a-Si is used has an electric current Id of 1 uA when the TFT has been turned on, whereas the TFT in which the oxide semiconductor has an electric current Id of approximately 20 uA to 50 uA when the TFT has been turned on.

This shows that the electron mobility at the time of an ON state is 20 to 50 times higher in the TFT in which the oxide semiconductor is used than in the TFT in which a-Si is used, and the TFT in which the oxide semiconductor is used thus has an excellent ON characteristic.

As previously described, the display device 2 of the present embodiment employs, for each pixel, the TFT in which the oxide semiconductor as described above is used. Accordingly, the display device 2 of the present embodiment can drive each pixel by use of the TFT which has an excellent ON characteristic and therefore is smaller in size. This allows reducing a ratio of an area occupied by the TFT in each pixel. That is, it becomes possible to increase an aperture ratio in each pixel, thereby increasing optical transmittance of backlight. This allows employing a backlight device with low power consumption as well as suppressing luminance of the backlight device. Consequently, a reduction in power consumption is achieved.

Further, since the TFT has the excellent ON characteristic, time required to write a data signal into each pixel can be shortened. This allows easily increasing a refresh rate of the display panel 2*a*.

In addition, as shown in FIG. 6, the TFT in which the oxide semiconductor is used has a less leak current at the time of an OFF state, as compared with the TFT in which a-Si is used.

Though not shown, specifically, the TFT in which a-Si is used has an electric current Id of 10 pA when the TFT has been turned off, whereas the TFT in which the oxide semiconductor is used has an electric current Id of approximately 0.1 pA when the TFT has been turned off.

This shows that the leak current at the time of an OFF state of the TFT in which the oxide semiconductor is used is approximately 1/100 of the leak current at the time of an OFF state of the TFT in which a-Si is used. The TFT in which the oxide semiconductor is used thus has an excellent OFF characteristic with almost no leak current.

Accordingly, the display device 2 of the present embodiment has an excellent OFF characteristic of the TFT, and can therefore maintain, for a long time, a state in which a data signal is written into each of the plurality of pixels of the display panel 2*a*. This allows the display device 2 to carry out the pause driving while maintaining a high display quality, and also to take a longer pause period.

The present invention is not limited to the above-described embodiments. A person skilled in the art can make various modifications of the present invention within the scope of the claims. In other words, new embodiment can be derived from a combination of technical means appropriately modified within the scope of the claims.

(Concrete Example of Polarity Inversion Cycle)

In the display device 2, it is only necessary that a polarity inversion cycle of the POL signal be at least one (1) frame. That is, the polarity inversion cycle may be either one frame or a plurality of frames. In a case where the polarity inversion cycle is one frame, the polarity of the data signal is reversed every frame in each scanning period. This enables a further reduction in influence of flicker, so that the display quality can be further enhanced. On the other hand, in a case where the polarity inversion cycle is a plurality of frames, a polarity inversion frequency of the data signal can be reduced, so that a further reduction in power consumption of the display device 2 is achieved.

In the case where the polarity inversion cycle is a plurality of frames, the number of frames constituting a scanning period and the number of frames constituting a pause period should each be a multiple of the polarity inversion cycle.

Regardless of a value of the polarity inversion cycle of the POL signal, an advantageous effect of the present invention can be brought about if the pause driving control section 8 operates in the following manner. First, the pause driving control section 8 calculates the number of frames constituting a scanning period and the number of frames constituting a pause period. Next, in a case where a sum of these numbers of the frames is a multiple of a polarity inversion cycle that is at least one (1), the pause driving control section 8 calculates a determination value which is a value obtained by dividing the sum by the polarity inversion cycle. In a case where the polarity inversion cycle is one (1) frame, the determination value is equal to the sum. As such, the sum itself can be treated as the determination value.

In a case where the calculated determination value is an even number, the pause driving control section 8 generates a control signal which alternately designates a scanning period constituted by the calculated number of frames and a pause period constituted by the calculated number of frames. On the other hand, in a case where the calculated determination value is an odd number, the pause driving control section 8 recalculates each of the number of frames constituting a scanning period and the number of frames constituting a pause period, until the determination value becomes an even number. These arrangements devised allow the display device 2 to maintain always a state in which the polarity of the voltage applied to liquid crystal in each pause period is prevented from being positive more often than negative, and vice versa.

For example, assuming a case in which the pause driving control section 8 calculates the number of frames constituting a scanning period as eight and the number of frames constituting a pause period as eight where the polarity inversion cycle is two frames, a sum of the calculated numbers of the frames in this case is 16, which is a multiple of two. Accordingly, the pause driving control section 8 calculates the determination value as 14÷2=8. Since the determination value thus calculated is an even number, the pause driving control section 8 generates a control signal which alternately designates a scanning period constituted by eight frames and a pause period constituted by eight frames, and the pause driving control section 8 supplies the control signal to the scanning line drive circuit 4 and the data line drive circuit 5. At this time, the polarity of the voltage applied to liquid crystal in the last frame in each scanning period is reversed every scanning period. This prevents the polarity of the voltage applied to liquid crystal in each pause period from being positive more often than negative, and vice versa.

On the other hand, for example, assuming a case in which the pause driving control section 8 calculates the number of frames constituting a scanning period as six and the number of frames constituting a pause period as eight where the polarity inversion cycle is two frames, a sum of the calculated numbers of the frames in this case is 14, which is a multiple of two. Accordingly, the pause driving control section 8 calculates the determination value as 16÷2=7. Since the determination value thus calculated is an odd number, the pause driving control section 8 recalculates each of the number of frames constituting a scanning period and the number of frames constituting a pause period, until the determination value becomes an even number. For example, the pause driving control section 8 recalculates the former as eight and the latter as eight. In this case, the determination value is 16÷2=8, which is an even number.

(Concrete Example of Pause Region)

The pause region in the screen of the display panel 2*a* is, for example, a region that accounts for a half of the screen, or a whole region of the screen. In a case where the pause region is the whole region of the screen, the supply of a scanning signal is stopped with respect to all of the plurality of scanning lines G in the screen in each pause period. This enables a further reduction in power consumption of the display device 2.

The present invention is not limited to the above-described embodiments but allows various modifications within the scope of the claims. In other words, any embodiment obtained by combining technical means appropriately modified within the scope of the claims will also be included in the technical scope of the present invention.

<Conclusion>

A display device in accordance with one aspect of the present invention is a display device which includes: a display panel including a plurality of scanning lines, a plurality of data lines intersecting with the plurality of scanning lines, and a plurality of pixels provided separately near at respective intersections of the plurality of scanning lines and the plurality of data lines; a control signal output section outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period is an even number; a polarity designation signal output section outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frame(s) within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and a drive circuit supplying the data signal to the each of the plurality of data lines in the each of the frames in the scanning period, the data signal having a polarity based on the polarity of the polarity designation signal supplied to the drive circuit in the each of the frames.

According to the arrangement, the display device in accordance with one aspect of the present invention carries out what is called pause driving. Specifically, the display device scans the whole region of the screen of the display panel in each of the frames in each scanning period, but does not scan the at least partial region of the screen in each of the frames in each pause period. This significantly reduces the power consumption of the display device in each pause period as compared with that in each scanning period. Accordingly, the display device in accordance with one aspect of the present invention can operate with electric power lower than that required in a display device that does not carry out the pause driving.

The polarity of the polarity designation signal in each of the frames in each scanning period is reversed every certain number of frame(s). The drive circuit supplies a data signal to each of the plurality of data lines in each of the frames in each scanning period, the data signal having a polarity that is based on the polarity of the polarity designation signal. Accordingly, in each of the frames in each scanning period, the polarity of the data signal supplied to each of the plurality of data lines is also reversed every certain number of frame(s) of a polarity inversion cycle.

In each pixel in each scanning period, a voltage having a polarity identical to that of the data signal outputted in each frame is applied to a corresponding pixel electrode. Accordingly, the voltage applied to the pixel electrode in each scanning period is reversed every certain number of frame(s) of the polarity inversion cycle.

On the other hand, a voltage is retained in the pixel electrode in each pixel in each pause period which voltage has a polarity identical to that of the data signal supplied to a corresponding one of the plurality of data lines in the last frame in a scanning period immediately preceding the each pause period. In the display device in accordance with one aspect of the present invention, the polarity of the polarity designation signal in each of the frames in each pause period is reversed, similarly as in each scanning period, every certain number of frame(s) of the polarity inversion cycle which is at least one (1) frame. Note, however, that the polarity of the polarity designation signal is reversed at a timing when switching from a scanning period to a pause period is carried out, and the polarity of the polarity designation signal is maintained without being reversed at a timing when switching from a pause period to a scanning period is carried out. Alternatively, the polarity of the polarity designation signal is maintained without being reversed at a timing when switching from a scanning period to a pause period is carried out, and the polarity of the polarity designation signal is reversed at a timing when switching from a pause period to a scanning period is carried out.

In any case, the polarity of the polarity designation signal in the first frame of each scanning period is reversed every scanning period. This is because the sum of the number of frames constituting a scanning period and the number of frames constituting a pause period is an even number. Consequently, the polarity of the polarity designation signal in the last frame of each scanning period is reversed every scanning period. Accordingly, the polarity of the pixel electrode retained in the each pixel in each pause period is reversed every pause period. These prevent the polarity of the pixel electrode in each pixel from becoming positive more often than negative, and vice versa, even when the display device continues operating.

As described above, the display device in accordance with one aspect of the present invention has the advantageous effect that the display device is capable of carrying out the pause driving and does not have image sticking on the display panel.

A method in accordance with one aspect of the present invention for driving a display device is a method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method including the steps of: (a) outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period is an even number; (b) outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frame(s) of a polarity inversion cycle, which is at least one (1), within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and (c) supplying the data signal to the each of the plurality of data lines in the each of the frames in the scanning period, the data signal having a polarity based on the polarity of the polarity designation signal supplied in the each of the frames.

The arrangement brings about an advantageous effect similar to the advantageous effect brought about by the display device in accordance with one aspect of the present invention.

A display device in accordance with one aspect of the present invention includes: a display panel including a plurality of scanning lines, a plurality of data lines intersecting with the plurality of scanning lines, and a plurality of pixels provided separately near at respective intersections of the plurality of scanning lines and the plurality of data lines; a control signal output section outputting a control signal which alternately designates a scanning period in which a whole region of a screen of the display panel is scanned and a pause period in which an at least partial region of the screen is not scanned, wherein a value obtained by dividing a sum of the number of frames constituting the scanning period and the number of frames constituting the pause period by a polarity inversion cycle that is two or more, is an even number; a polarity designation signal output section outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frames of the polarity inversion cycle within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and a drive circuit supplying the data signal to the each of the plurality of data lines and in the each of the frames in the scanning period, the data signal having a polarity based on the polarity of the polarity designation signal supplied to the drive circuit in the each of the frames.

According to the arrangement, the display device in accordance with one aspect of the present invention carries out what is called pause driving. Specifically, the display device scans the whole region of the screen of the display panel in each of the frames in each scanning period, but does not scan the at least partial region of the screen in each of the frames in each pause period. This significantly reduces the power consumption of the display device in each pause period as compared with that in each scanning period. Accordingly, the display device in accordance with one aspect of the present invention can operate with electric power lower than that required in a display device that does not carry out the pause driving.

The polarity of the polarity designation signal in each of the frames in each scanning period is reversed every certain number of frames of the polarity inversion cycle which is two or more. The drive circuit supplies a data signal to each of the plurality of data lines in each of the frames in each scanning period, the data signal having a polarity that is based on the polarity of the polarity designation signal. Accordingly, in each of the frames in each scanning period, the polarity of the data signal supplied to each of the plurality of data lines is also reversed every certain number of frames of the polarity inversion cycle.

In each pixel in each scanning period, a voltage having a polarity identical to that of the data signal outputted in each frame is applied to a corresponding pixel electrode. Accordingly, the voltage applied to the pixel electrode in each scanning period is reversed every certain number of frames of the polarity inversion cycle.

On the other hand, a voltage is retained in the pixel electrode in each pixel in each pause period which voltage has a polarity identical to that of the data signal supplied to a corresponding one of the plurality of data lines in the last frame in a scanning period immediately preceding the each pause period. In the display device in accordance with one aspect of the present invention, the polarity of the polarity designation signal in each of the frames in each pause period is reversed, similarly as in each scanning period, every certain number of frames of the polarity inversion cycle which is at least one (1) frame. Note, however, that the polarity of the polarity designation signal is reversed at a timing when switching from a scanning period to a pause period is carried out, and the polarity of the polarity designation signal is maintained without being reversed at a timing when switching from a pause period to a scanning period is carried out. Alternatively, the polarity of the polarity designation signal is maintained without being reversed at a timing when switching from a scanning period to a pause period is carried out, and the polarity of the polarity designation signal is reversed at a timing when switching from a pause period to a scanning period is carried out.

In any case, the polarity of the polarity designation signal in the first frame of each scanning period is reversed every scanning period. This is because the value obtained by dividing the sum of the number of frames constituting a scanning period and the number of frames constituting a pause period by the polarity inversion cycle is an even number. Consequently, the polarity of the polarity designation signal in the last frame of each scanning period is reversed every scanning period. Accordingly, the polarity of the pixel electrode retained in the each pixel in each pause period is reversed every pause period. These prevent the polarity of the pixel electrode in each pixel from becoming positive more often than negative, and vice versa, even when the display device continues operating.

As described above, the display device in accordance with one aspect of the present invention has the advantageous effect that the display device is capable of carrying out the pause driving and does not have image sticking on the display panel.

A method in accordance with one aspect of the present invention for driving a display device is a method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method comprising the steps of: (a) outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period by a polarity inversion cycle that is two or more, is an even number; (b) outputting a polarity designation signal, which designates a polarity of a data signal supplied to each of the plurality of data lines, the polarity designation signal being outputted in each of the frames in the scanning period and in each of the frames in the pause period while a polarity of the polarity designation signal is reversed every certain number of frames of the polarity inversion cycle within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and (c) supplying the data signal to the each of the plurality of data lines in the each of the frames in the scanning period, the data signal having a polarity based on the polarity of the polarity designation signal supplied in the each of the frames.

The arrangement brings about an advantageous effect similar to the advantageous effect brought about by the display device in accordance with one aspect of the present invention.

The display device in accordance with one aspect of the present invention is preferably arranged such that the display device further includes a designation signal reception section which receives a designation signal supplied from the outside of the display device, the designation signal including (i) information indicative of the number of the frames constituting the scanning period and (ii) information indicative of the number of the frames constituting the pause period, the control signal output section calculating, on the basis of the control signal, the number of the frames constituting the scanning period and the number of the frames constituting the pause period.

The arrangement allows the pause driving carried out by the display device to be controlled from the outside of the display device.

The display device in accordance with one aspect of the present invention is preferably arranged such that the display device further includes a video signal reception section which receives a video signal supplied from the outside of the display device, the control signal output section calculating, on the basis of the video signal, the number of the frames constituting the scanning period and the number of the frames constituting the pause period The arrangement allows optimum pause driving to be carried out in accordance with the video signal.

The display device in accordance with one aspect of the present invention is preferably arranged such that the display device further includes a storage section in which first information indicative of the number of the frames constituting the scanning period and second information indicative of the number of the frames constituting the pause period are stored, the control signal output section calculates, on the basis of the first information and the second information, the number of the frames constituting the scanning period and the number of the frames constituting the pause period.

The arrangement allows optimum pause driving to be carried out in accordance with the first information and the second information which are stored in advance in the storage section.

The display device in accordance with one aspect of the present invention is preferably arranged such that the at least partial region is the whole region of the screen.

The arrangement allows a further reduction in power consumption of the display device.

The display device in accordance with one aspect of the present invention is preferably arranged such that each of the plurality of pixels includes a TFT which includes a semiconductor layer constituted by an oxide semiconductor. Specifically, the oxide semiconductor is preferably IGZO.

Accordingly to the arrangement, the display device has an excellent OFF characteristic of the TFT of each of the plurality of pixels, and can therefore maintain, for a long time, a state in which a data signal is written into each of the plurality of pixels of the display panel. This allows the display device to carry out the pause driving while maintaining a high display quality, and also to take a longer pause period.

The display device in accordance with one aspect of the present invention is preferably arranged such that the display device is a liquid crystal display device.

The arrangement allows providing a liquid crystal display device which is capable of carrying out the pause driving and does not have image sticking on a display panel.

INDUSTRIAL APPLICABILITY

The display device of the present invention can be utilized as a wide variety of display devices, such as a liquid crystal display device, which carry out the pause driving and the reverse polarity driving simultaneously.

REFERENCE SIGNS LIST

1: DISPLAY SYSTEM
2: DISPLAY DEVICE
2A: DISPLAY PANEL
3: CONTROL SECTION
4: SCANNING LINE DRIVE CIRCUIT
5: DATA LINE DRIVE CIRCUIT (DRIVE CIRCUIT)
6: COMMON ELECTRODE DRIVE CIRCUIT
7: TIMING CONTROL SECTION
8: PAUSE DRIVING CONTROL SECTION (CONTROL SECTION)
9: POLARITY INVERSION CONTROL SECTION (POLARITY DESIGNATION SIGNAL OUTPUT SECTION)

The invention claimed is:

1. A display device comprising:

a display panel including a plurality of scanning lines, a plurality of data lines intersecting with the plurality of scanning lines, and a plurality of pixels provided separately near at respective intersections of the plurality of scanning lines and the plurality of data lines;

a control signal output section outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period is an even number;

a polarity designation signal output section outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frame(s) within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and a drive circuit supplying the data signal to the each of the plurality of data lines in the each of the frames in the scanning period, the data signal having a polarity based on the polarity of the polarity designation signal supplied to the drive circuit in the each of the frames.

2. A display device as set forth in claim 1, further comprising a designation signal reception section which receives a designation signal supplied from the outside of the display device, the designation signal including (i) information indicative of the number of the frames constituting the scanning period and (ii) information indicative of the number of the frames constituting the pause period, the control signal output section calculating, on the basis of the designation signal, the number of the frames constituting the scanning period and the number of the frames constituting the pause period.

3. A display device as set forth in claim 1, further comprising a video signal reception section which receives a video signal supplied from the outside of the display device, the control signal output section calculating, on the basis of the video signal, the number of the frames constituting the scanning period and the number of the frames constituting the pause period.

4. A display device as set forth in claim 1, further comprising a storage section in which first information indicative of the number of the frames constituting the scanning period and second information indicative of the number of the frames constituting the pause period are stored, the control signal output section calculates, on the basis of the first information and the second information, the number of the frames constituting the scanning period and the number of the frames constituting the pause period.

5. The display device as set forth in claim 1, wherein the at least partial region is the whole region of the screen.

6. The display device as set forth in claim 1, wherein each of the plurality of pixels includes a TFT which includes a semiconductor layer constituted by an oxide semiconductor.

7. The display device as set forth in claim 6, wherein the oxide semiconductor is IGZO.

8. The display device as set forth in claim 1, wherein the display device is a liquid crystal display device.

9. A display device comprising:

a display panel including a plurality of scanning lines, a plurality of data lines intersecting with the plurality of scanning lines, and a plurality of pixels provided separately near at respective intersections of the plurality of scanning lines and the plurality of data lines;

a control signal output section outputting a control signal which alternately designates a scanning period in which a whole region of a screen of the display panel is scanned and a pause period in which an at least partial region of the screen is not scanned, wherein a value obtained by dividing a sum of the number of frames constituting the scanning period and the number of frames constituting the pause period by a polarity inversion cycle that is two or more, is an even number;

a polarity designation signal output section outputting a polarity designation signal which designates a polarity of a data signal supplied to each of the plurality of data lines, the polarity designation signal being outputted in each of the frames in the scanning period and in each of the frames in the pause period while a polarity of the polarity designation signal is reversed every certain number of frames of the polarity inversion cycle within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and a drive circuit supplying the data signal to the each of the plurality of data lines and in the each of the frames in the scanning period, the data signal having a polarity based on the polarity of the polarity designation signal supplied to the drive circuit in the each of the frames.

10. A display device as set forth in claim 9, further comprising a designation signal reception section which receives a designation signal supplied from the outside of the display device, the designation signal including (i) information indicative of the number of the frames constituting the scanning period and (ii) information indicative of the number of the frames constituting the pause period, the control signal output section calculating, on the basis of the designation signal, the number of the frames constituting the scanning period and the number of the frames constituting the pause period.

11. A display device as set forth in claim 9, further comprising a video signal reception section which receives a video signal supplied from the outside of the display device, the control signal output section calculating, on the basis of the video signal, the number of the frames constituting the scanning period and the number of the frames constituting the pause period.

12. A display device as set forth in claim 9, further comprising a storage section in which first information indicative of the number of the frames constituting the scanning period and second information indicative of the number of the frames constituting the pause period are stored, the control signal output section calculates, on the basis of the first information and the second information, the number of the frames constituting the scanning period and the number of the frames constituting the pause period.

13. The display device as set forth in claim 9, wherein the at least partial region is the whole region of the screen.

14. The display device as set forth in claim 9, wherein each of the plurality of pixels includes a TFT which includes a semiconductor layer constituted by an oxide semiconductor.

15. The display device as set forth in claim 14, wherein the oxide semiconductor is IGZO.

16. The display device as set forth in claim 9, wherein the display device is a liquid crystal display device.

17. A method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method comprising the steps of:

(a) outputting a control signal which alternately designates a scanning period in which a whole region of a screen of the display panel is scanned and a pause period in which an at least partial region of the screen is not scanned, wherein a sum of the number of frames constituting the scanning period and the number of frames constituting the pause period by a polarity inversion cycle that is two or more, is an even number;

(b) outputting a polarity designation signal, which designates a polarity of a data signal supplied to each of the plurality of data lines, the polarity designation signal being outputted in each of the frames in the scanning period and in each of the frames in the pause period while a polarity of the polarity designation signal is reversed every certain number of frames of the polarity inversion cycle within each of the scanning period and the pause period so that the polarity of the polarity designation signal (i) is reversed at a timing when switching from the scanning period to the pause period is carried out and is maintained at a timing when switching from the pause period to the scanning period is carried out or (ii) is maintained at a timing when switching from the scanning period to the pause period is carried out and is reversed at a timing when switching from the pause period to the scanning period is carried out; and (c) supplying the data signal to the each of the plurality of data lines in the each of the frames in the scanning period, the data signal having a polarity based on the polarity of the polarity designation signal supplied in the each of the frames.

* * * * *